United States Patent [19]

Johansson

[11] Patent Number: 4,807,512

[45] Date of Patent: Feb. 28, 1989

[54] APPARATUS FOR OPERATING THE BOLT IN AUTOMATIC WEAPONS

[76] Inventor: Bertil Johansson, Brusensgatan 3B, S-633, 47 Eskilstuna, Sweden

[21] Appl. No.: 92,461

[22] Filed: Sep. 3, 1987

[30] Foreign Application Priority Data

Sep. 5, 1986 [SE] Sweden ..... 8603733

[51] Int. Cl.[4] ..... F41D 11/00

[52] U.S. Cl. ..... 89/1.4; 89/199

[58] Field of Search ..... 89/1.4, 199

[56] References Cited

U.S. PATENT DOCUMENTS

| | | | |
|---|---|---|---|
| 1,249,622 | 12/1917 | Hedrick | 89/199 |
| 1,897,099 | 1/1933 | Woody et al. | 89/1.4 |
| 2,659,994 | 11/1953 | Yole | 89/199 |
| 2,845,001 | 7/1958 | Hillberg | 89/1.4 |
| 4,048,901 | 9/1977 | Ghisoni | 89/199 |

*Primary Examiner*—David H. Brown

*Attorney, Agent, or Firm*—McCormick, Paulding & Huber

[57] ABSTRACT

Automatically feeding firearm having a bolt (2) which upon shooting is reciprocally moving in the receiver (1) of the weapon actuated by a recoil spring (4), and in which the bolt (2) when being set for firing its first shot, for the purpose of executing its function, is pulled back and is kept tensioned in the receiver until a trigger bar or a similar lock means releases the bolt, or alternatively the bolt is directly returned to a front position after having brought a cartridge from the magazine into a cartridge position and after having tensioned a separate firing mechanism, and in which the weapon is formed with an actuation bar (5) projecting from the back (9) of the weapon and adapted for tensioning the bolt (2) by being pulled rearwardly, which bar after said tensioning of the bolt is adapted to be returned to its initial front position. The actuation bar can be a separate actuation bar or preferably a recoil spring bar (5) which is received in a groove (3) of the bolt (2), and about which the recoil spring (4) is guided.

12 Claims, 2 Drawing Sheets

APPARATUS FOR OPERATING THE BOLT IN AUTOMATIC WEAPONS

The present invention generally relates to automatically feeding hand weapons, for instance machine pistols and similar automatic or semi-automatic weapons, and is more particularly directed to an improved apparatus for operating the bolt in such hand weapons.

In order to set such weapons into shooting condition the bolt must be drawn to a shooting position. Most automatically feeding weapons known to-day are disadvantageous as concerns the way of actuating the bolt from outside the receiver.

The most usual and simplest embodiment of an apparatus for operating the bolt consists of a fixed or releasable handle which is mounted in the bolt and which projects through a slot of the receiver of the weapon and which during shooting moves reciprocally together with the bolt. This apparatus is disadvantageous in several respects. The slot for the handle, which extends over a substantial part of the length of the receiver reduces the strength of the receiver. The handle which reciprocates during firing may irritate the marksman or may in the worst case injure the marksman, and it may get caught in adjacent objects. An enemy who is allowed to get too close to the marksman may with a quick and well positioned grab in front of the handle make further shooting impossible. Since the handle is generally placed on the right side or on the left side the weapon cannot be handled properly with both hands but is mainly intended either for right handed or for left handed marksmen respectively. If the handle is placed on top or the receiver it often impedes the mounting of optical sights etc. The unprotected slot for the handle allows snow, water, sand and other foreign material to enter the receiver, which may interrupt firing or may damage the weapon. Since the handle must, for space saving reasons, be made rather small it may, under some circumstances, be difficult to get a good grip of the handle to complete a correct loading movement, for instance when using coarse gloves, in cool weather etc. This may lead to accidental firing or may prevent intended firing. Accidental firing also may occur if the projecting handle gets caught in some part of the equipment of the marksman or in any adjacent object.

A number of more or less complicated constructions have been suggested, which may solve only some of the above mentioned problems.

The present invention is intended to overcome all of the above mentioned problems and shortcomings found in previously known hand weapons of automatic or semi-automatic type and to provide a simple and effective apparatus for actuating the bolt from outside the weapon, whereby, above all, the previously usual slot in the receiver and the handle projecting through said slot is eliminated. The present invention is mainly charaacterized in that the actuation means for the bolt is a bar or rod which projects through a bore in the rear wall of the receiver.

Further characteristics of the invention will be evident from the following detailed specifiction in which reference will be made to the accompanying drawings. It is, however, to be understood that said specification and the embodiments of the invention shown in the drawings are only for illustating purposes, and that many different variations and modifications may be presented within the scope of the appended claims.

In the drawings FIG. 1 shows a side view, partly in a cross section, of an automatic hand weapon formed with the apparatus according to the invention for operating the bolt in a loading movement.

Figure 1:
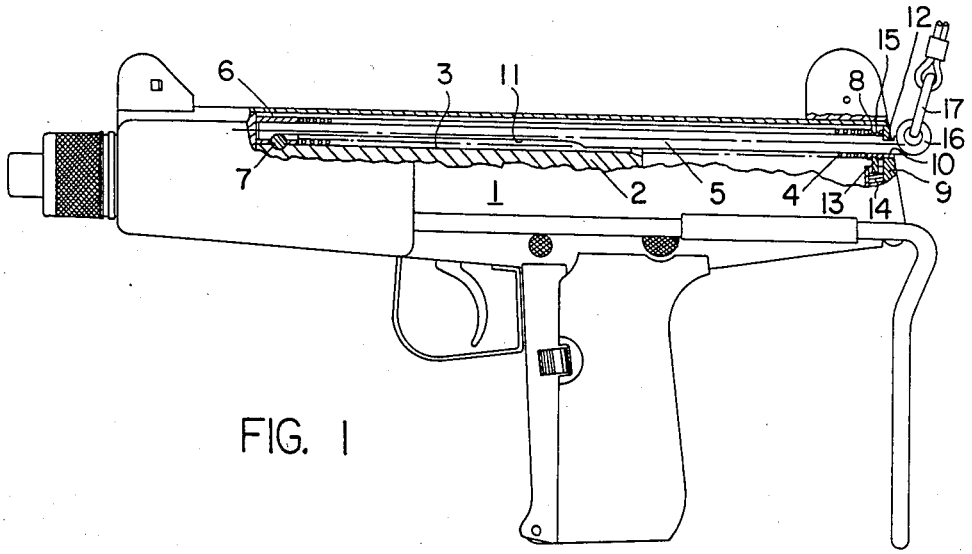

The automatic weapon shown in FIG. 1 is a machine pistol, the main design of which is of known type and will not be described in detail. The parts of the weapon which are important to the invention are the receiver 1, in which the bolt 2 is slidably guided between a rear loading position (not illustrated) and a front resting and firing position respectively, a recoil spring 4 and a recoil spring bar or bolt actuating rod 5.

The upper part of the bolt 2 is formed with a longitudinal groove or bore 3 which provides a space for a recoil spring 4, which is guided on a recoil spring bar 5. The front end of the recoil spring 4 is in contact with a bolt sleeve 6 which is secured to the bolt 2. The rear end of the recoil spring 4 is in contact with a bushing 8, which, in turn, slidably rests against the back wall 9 of the receiver. The recoil spring bar 5 is substantially cylindrical and adapted to project through a cylindrical bore 10 in the back wall 9.

Figure 2:
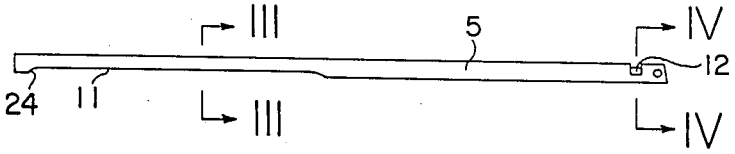
FIG. 2 is a side view of a detail of the apparatus according to the invention.
Figure 3:
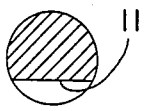
FIGS. 3 and 4 are cross sectional views, in a larger scale, along lines III—III and IV—IV respectively of FIG. 2.
Figure 4:
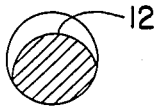

As best shown in FIGS. 2–4 the recoil spring bar 5 is formed with two recesses, namely a relatively long bottom/front recess 11 and an upper recess 12 adjacent the rear end of the recoil spring bar 5.

The bottom/front recess 11 extends from a location adjacent the front end of the recoil spring bar 5 and within the area of the bolt sleeve 6 a distance back which is at least as long as the operating distance of the bolt 2 from its rear reverse position to its front firing or resting position. The elongated recess 11 defines a rearwardly facing shoulder 24 and has a depth which is the same as or slightly greater than the height of a cross bolt 7, so that the bolt together with the bolt sleeve 6 and the cross bolt 7 can move freely between its rear reverse position and its front firing or resting position.

The rear recess 12 extends radially a distance corresponding to about half the radius in the bar 5, and the axial length thereof is slightly larger than the thickness of the material of the back 9 of the receiver, so that it can be locked against said back wall when the recoil spring bar 5 is pressed upwards, whereby a part of the back wall is received in the recess 12. In order to provide such upward bias to the recoil spring bar 5 a pin or an arm 13 located adjacent the back wall 9 is pressed upward by a spring 14 into contact with the slidable bushing 8, which preferably has an annular groove 15 for receiving the upper end of the arm 13.

As evident the apparatus is formed so that the bolt can be moved back from the front firing and resting position, shown in FIG. 1, when the rear end of the recoil spring bar 5 is pressed downward so that the rear upper recess 12 is freed from the upper edge of the bore 10 of the back wall 9, whereupon the recoil spring bar 5 is pulled back together with the bolt 2 which during this movement is kept secured by the cross bolt 7. The bolt is pulled back as far as to its cocked or charge position, in which position it is hooked by the trigger bar. The front lower recess 11 is made sufficiently long so that the recoil spring can freely be expelled as far as to its illustrated front position where it is locked by engagement of the rear wall 9 within the recess 12. The recess 12 thereby guarantees that the recoil spring bar 5 does not un-intentionally, for instance due to friction, follow the bolt in its movement rearwardly when the weapon is fired. After the bolt has been tensioned, as described above, the recoil spring bar 5 is returned to its front position and remains in this position as long as firing continues and until the rear end of the bar 5 is once again pressed down for once again tensioning the bolt.

In order to make it possible to actuate the recoil spring bar from outside it is necessary that the projecting rear part thereof is formed with a hold, and this may be a T-formed or ring-formed finger hold. In the illustrated case the hold is a ring 16, which provides an attachment part for the sling ring 17 of the weapon. This means that the weapon sling is used to actuate the recoil spring bar for charge-tensioning or cocking the bolt.

The correct manipulation of the weapon is as follows:

1. Grasp the weapon sling adjacent the sling ring 17 and press the recoil spring 5 downwards, so that the recess 12 disengages from the receiver back 9;
2. Pull the recoil spring bar 5 rearwardly until the bolt has become hooked by the trigger bar or a corresonding holding means;
3. Return the recoil spring bar 5 to its front locking position.

If the weapon in question is of the type that does not shoot with the bolt hooked in its rear position but with the bolt in the front position the recoil spring bar is pulled to its rearmost position and is then released. The recoil spring thereby biases both the bolt and the recoil spring bar to its front position.

If, for instance, due to lack of time, the recoil spring bar 5 should not be returned from its rear position to its front locking position after the bolt has been tensioned, the bolt 2 will, upon firing the first shot, bring the recoil spring bar 5 to its front locking position, in which position the recoil spring bar is locked by engagement of the receiver back wall 9 within the recess 12.

Figure 5:
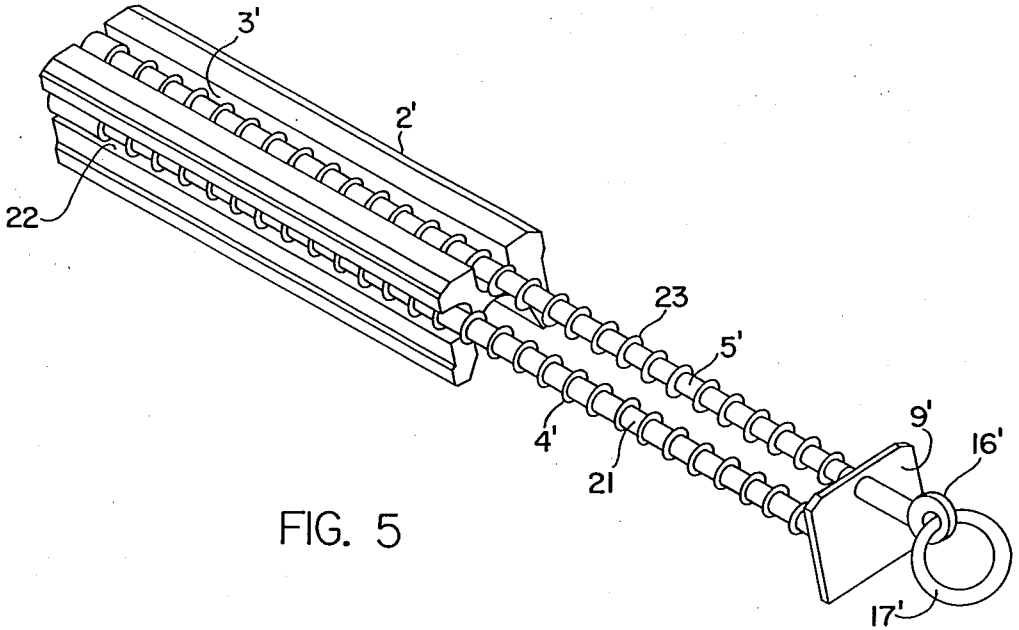
FIG. 5 is a somewhat enlarged fragmentary perspective view illustrating another embodiment of the invention.

Another embodiment of the invention shown in FIG. 5 includes a bolt, indicated at 2' and a recoil spring 4' supported by a recoil spring guide rod 21, which engages the back wall 9'. The connection between the front end of the recoil spring guide rod 21 and the bolt 2' is similar to the connection between the bolt 2 and the bolt actuating rod 5, previously described, so that the bolt 2' is free to reciprocate within the receiver (not shown) and relative to the recoil spring guide rod 21. The recoil spring 4' and its guide rod 21 are received within a groove 22 in the bolt 2'.

The bolt actuating rod 5' is substantially identical in all respects to the bolt actuating rod 5, previously described. However, the rod 5' carries a return spring 23 which biases the bolt actuating rod 5' to its first position independently of the recoil spring 4'.

I claim:

1. In an automatically feeding hand held firearm having a receiver (1) including a back wall (9), a bolt (2) supported for reciprocal movement within the receiver between cocking and firing positions, a recoil spring (4) for biasing the bolt position toward its firing position, and means for moving the bolt to its cocking position including a bolt actuating rod (5) projecting rearwardly beyond the back wall (9) and movable between first and second positions corresponding respectively to the firing and cocking positions of the bolt, the bolt (2) being movable between its firing and cocking positions independently of the movement of the bolt actuating rod (5) when the bolt actuating rod (5) is in its first position, the improvement comprising said bolt actuating rod (5) projecting rearwardly from said receiver (1) through a bore (10) in said back wall (9), and latching means for releasably retaining said bolt actuating rod (5) in its first position including a rear recess (12) in the rear end portion of said bolt actuating rod (5) for receiving therein an associated bore defining portion of said rear wall (9) when said bolt actuating rod (5) is in its first position to retain said bolt actuating rod (5) in fixed position relative to said rear wall (9), and means for biasing said bolt actuating rod (5) toward said bore defining portion.

2. In an automatically feeding hand held firearm as set forth in claim 1 the further improvement wherein said bolt (2) has a groove (3) therein, said recoil spring is received on and guided by said bolt actuating rod (5), and said recoil spring (4) and said bolt actuating rod (5) are received within said groove (3).

3. In an automatically feeding hand held firearm as set forth in claim 1 the further improvement wherein said means for moving said bolt to its cocking position includes a sling ring (17) connected to the rear end portion of said bolt actuating rod (5) for connecting a sling thereto whereby the sling may be employed to release said latching means and move said bolt actuating rod from its first position to its second position to cock said firearm.

4. In an automatically feeding hand held firearm as set forth in claim 1 the further improvement wherein said bolt actuating rod (5) is slidably engaged with said bolt and has a rearwardly facing shoulder (24) engaging said bolt when said bolt is in its firing position and said bolt actuating rod (5) is in its first position.

5. In an automatically feeding hand held firearm as set forth in claim 4 the further improvement wherein said bolt actuating rod (5) has an elongated front recess (11) therein defining said shoulder 24 and said bolt carries a cross-pin (7) which extends transversely of said front recess (11) and is engaged by said shoulder (24) when said bolt (2) is in its firing position and said bolt actuating rod (5) is in its first position.

6. In an automatically feeding hand held firearm as set forth in claim 1 the further improvement comprising said firearm including means for biasing said bolt actuating rod (5) toward its first position.

7. In an automatically feeding hand held firearm as set forth in claim 6 the further improvement wherein said recoil spring (4) is received on said bolt actuating rod (5) and comprises said means for biasing said bolt actuating rod (5) toward said first position.

8. In an automatically feeding hand held firearm as set forth in claim 6 the further improvement comprising a recoil spring guide rod receiving said recoil spring (4) thereon and said means for biasing said bolt actuating rod comprises a return spring (23) received on said bolt actuating rod (5).

9. In an automatically feeding hand held firearm as set forth in claim 1 the further improvement wherein said latching means includes a bushing (8) slidably received on said bolt actuating rod (5), means for maintaining said bushing (8) in sliding engagement with said back wall (9), and a spring (14) acting upon said bushing (8).

10. In an automatically feeding hand held firearm as set forth in claim 9 the further improvement wherein said means for maintaining said bushing (8) comprises means for biasing said bolt actuating rod (5) to its first position.

11. In an automatically feeding hand held firearm as set forth in claim 10 the further improvement wherein said means for maintaining said bushing (8) comprises said recoil spring (4).

12. In an automatically feeding hand held firearm as set forth in claim 10 the further improvement comprising a recoil spring guide rod (21) receiving said recoil spring (4') thereon and said means for biasing said bolt actuating rod (5) comprises a return spring (23) received on said bolt actuating rod (5).

* * * * *